US007435895B2

(12) United States Patent
Muramatsu

(10) Patent No.: US 7,435,895 B2
(45) Date of Patent: Oct. 14, 2008

(54) AUTOMATIC PLAYING SYSTEM USED FOR MUSICAL INSTRUMENTS AND COMPUTER PROGRAM USED THEREIN FOR SELF-TEACHING

(75) Inventor: Shigeru Muramatsu, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 0 days.

(21) Appl. No.: 11/620,741

(22) Filed: Jan. 8, 2007

(65) Prior Publication Data

US 2007/0221035 A1 Sep. 27, 2007

(30) Foreign Application Priority Data

Mar. 22, 2006 (JP) ..... 2006-079756

(51) Int. Cl.
*G10H 1/46* (2006.01)
*G10F 1/02* (2006.01)

(52) U.S. Cl. ..... 84/741; 84/737; 84/723; 84/13; 84/21; 84/22

(58) Field of Classification Search ..... 84/13, 84/21, 22, 454, 105, 737, 741
See application file for complete search history.

(56) References Cited

U.S. PATENT DOCUMENTS 1,504,531 A * 8/1924 Thomson et al. ..... 84/25
1,530,123 A * 3/1925 Jones ..... 84/107
1,724,140 A * 8/1929 Mills ..... 84/11
2,488,170 A * 11/1949 Calamari et al. ..... 84/110
2,953,957 A * 9/1960 Skinner et al. ..... 84/105
3,195,389 A * 7/1965 Percy ..... 84/5
3,709,085 A * 1/1973 Del Castillo ..... 84/166
4,450,749 A * 5/1984 Stahnke ..... 84/462
4,469,000 A * 9/1984 Fujiwara et al. ..... 84/115
4,592,262 A * 6/1986 Yang ..... 84/115
4,791,849 A * 12/1988 Kelley ..... 84/458
4,843,936 A * 7/1989 Murakami et al. ..... 84/107
4,889,029 A * 12/1989 St. Denis ..... 84/454
4,909,126 A * 3/1990 Skinn et al. ..... 84/454
5,042,353 A * 8/1991 Stahnke ..... 84/21

(Continued)

FOREIGN PATENT DOCUMENTS

EP 1624444 A1 2/2006

(Continued)

*Primary Examiner*—Lincoln Donovan
*Assistant Examiner*—Robert W Horn
(74) *Attorney, Agent, or Firm*—Harness, Dickey & Pierce, PLC

(57) ABSTRACT

An automatic playing system is independent of acoustic pianos, and is designed to perform music tunes expressed by sets of MIDI music data codes on the acoustic pianos; since the acoustic pianos have their own individualities, control parameter table, which were prepared through experiments on a standard piano, are not optimum for most of the acoustic pianos due to the individualities: the automatic playing system can tailor the control parameter tables defining relation between the magnitude of driving signal and the MIDI velocity and relation between the magnitude of driving signal and time lag from the supply of the driving signal and the collision between the hammers and the strings for each sort of acoustic pianos before the automatic playing so that the automatic playing system reproduces the music tunes at high fidelity regardless of the sort of acoustic pianos.

19 Claims, 8 Drawing Sheets

U.S. PATENT DOCUMENTS 5,065,660 A * 11/1991 de Buda ..... 84/200
5,083,491 A * 1/1992 Fields ..... 84/21
5,164,532 A * 11/1992 Ishii et al. ..... 84/639
5,200,570 A * 4/1993 Kawamura ..... 84/737
5,210,367 A 5/1993 Taguchi et al.
5,343,793 A * 9/1994 Pattie ..... 84/454
5,345,036 A * 9/1994 Kondo ..... 84/633
5,357,047 A * 10/1994 Isozaki et al. ..... 84/47
5,390,579 A * 2/1995 Burgon ..... 84/454
5,432,295 A * 7/1995 Matsunaga et al. ..... 84/615
5,530,198 A * 6/1996 Ishii ..... 84/21
5,565,635 A * 10/1996 Kaneko et al. ..... 84/20
5,614,688 A * 3/1997 Donnell ..... 84/743
5,756,910 A * 5/1998 Fields et al. ..... 84/20
5,756,913 A * 5/1998 Gilmore ..... 84/454
6,051,762 A 4/2000 Fujiwara et al.
6,153,819 A * 11/2000 Yorba ..... 84/20
6,166,307 A * 12/2000 Caulkins et al. ..... 84/50
6,271,447 B1 * 8/2001 Fujiwara et al. ..... 84/21
6,288,313 B1 * 9/2001 Sato et al. ..... 84/177
6,362,405 B2 * 3/2002 Koseki et al. ..... 84/2
6,437,226 B2 * 8/2002 Oudshoorn et al. ..... 84/454
6,479,738 B1 * 11/2002 Gilmore ..... 84/454
6,559,369 B1 * 5/2003 Gilmore ..... 84/455
6,888,052 B2 * 5/2005 Meisel ..... 84/16
6,906,695 B1 * 6/2005 Ishida et al. ..... 345/156
7,015,390 B1 * 3/2006 Rogers ..... 84/723
7,202,409 B2 * 4/2007 Fujiwara et al. ..... 84/743
7,217,880 B2 * 5/2007 Sant ..... 84/645
7,247,789 B2 * 7/2007 Fishman et al. ..... 84/723
7,265,281 B2 * 9/2007 Sasaki et al. ..... 84/13
7,279,630 B2 * 10/2007 Sasaki et al. ..... 84/723
7,285,709 B2 * 10/2007 White et al. ..... 84/321
7,390,956 B2 * 6/2008 Fujiwara ..... 84/615
2005/0235801 A1 10/2005 Muramatsu et al.
2006/0054010 A1 * 3/2006 Sasaki ..... 84/744
2006/0101978 A1 * 5/2006 Honeywell et al. ..... 84/13
2006/0213357 A1 * 9/2006 Ohba ..... 84/723
2007/0221035 A1 * 9/2007 Muramatsu ..... 84/13
2007/0221036 A1 * 9/2007 Fujiwara ..... 84/21
2007/0256550 A1 * 11/2007 Muramatsu ..... 84/719

FOREIGN PATENT DOCUMENTS

JP HEI-2005-309024 11/2005

* cited by examiner

AUTOMATIC PLAYING SYSTEM USED FOR MUSICAL INSTRUMENTS AND COMPUTER PROGRAM USED THEREIN FOR SELF-TEACHING

FIELD OF THE INVENTION

This invention relates to an automatic playing system for a keyboard musical instrument and, more particularly, to an automatic playing system combined with a keyboard musical instrument for playing a music passage on the keyboard musical instrument and a computer program employed in the automatic playing system for self-teaching.

DESCRIPTION OF THE RELATED ART

In the following description, term "front" is indicative of a position closer to a human player, who is sitting on a stool for fingering, than a corresponding position modified with term "rear". Term "fore-and-aft direction" is indicative of a direction of line drawn between a front position and a corresponding rear position, and a "lateral direction" crosses the fore-and-aft direction at right angle. Term "up-and-down direction" is normal to the plane defined by the fore-and-aft direction and lateral direction.

An acoustic piano is a typical example of the keyboard musical instrument. A keyboard is mounted on a terrace of a piano cabinet which called as a key bed, and action units, hammers, strings, pedals and pedal mechanisms are housed in the piano cabinet. The three pedals are called as a damper pedal, a soft pedal and a sostenuto pedal, and project in the frontward direction from the lower portion of the piano cabinet. The three pedals are respectively linked with the pedal mechanisms, and a pianist gives artificial expressions to a music passage by selectively pressing down the three pedals.

The keyboard has black keys and white keys, and the black keys and white keys are linked with the action units, respectively. The action units are respectively linked with the hammers, and the strings are respectively provided on trajectories of hammers.

A pianist is assumed to perform a piece of music on the acoustic piano. The pianist selectively depresses and releases the black keys and white keys in his or her performance. The depressed keys actuate the associated action units, and the actuated action units give rise to rotation of the associated hammers toward the strings. The hammers are brought into collision with the associated strings at the end of rotation, and give rise to vibrations of the strings. Thus, the key movements finally give rise to vibrations of the associated strings. The vibrating strings give rise to vibrations of a soundboard of the piano cabinet, and the acoustic piano tones are radiated from the acoustic piano.

The hammers rebound on the strings, and are captured by back checks. When the depressed keys are released, the released keys start to return to the rest positions due to the weight of the action units.

The pianist gives artificial expression to the music passage through various finger techniques. When the human player emphasizes a tone, he or she strongly depresses the associated key. On the other hand, when the human player thinks it proper to decrease the loudness of some tones, he or she softly depresses the associated key.

The strongly depressed key travels at high speed, and causes the associated action unit to drive the hammer for rotation through rapid escape. This results in high-speed hammer rotation, and the hammer is strongly brought into collision with the string. On the other hand, when the human player wishes to reduce the loudness of the acoustic piano tone, he or she softly depresses the associated key so that the associated action unit drives the hammer for low-speed rotation. The hammer is brought into soft collision with the string, and the string weakly vibrates for producing the acoustic piano tone at small loudness. The force, which is exerted on the black keys and white keys, is proportional to the hammer velocity, which in turn is proportional to the loudness of the acoustic piano tones. Thus, the human player controls the loudness of acoustic piano tones through the touch on the black keys and white keys.

An automatic player piano is known as a hybrid keyboard musical instrument between the acoustic piano and the automatic playing system. The automatic playing system includes an array of key actuators and a controller connected to the key actuators. The array of key actuators are provided below the rear portions of black keys and the rear portions of which keys, and each of the key actuators has a solenoid connected to the controller and a plunger projectable from and retractable into the solenoid.

When a black key or a white key is to be depressed in an automatic playing, a driving signal is supplied from the controller to the key actuator associated with the black/white key, and the magnetic force is exerted on the plunger in the upward direction. The plunger pushes up the rear portion of the black/white key so that the black/white key behaves as if a human player depresses the black/white key. The plunger exerts the force on the black/white key, and the force is proportional to the amount of current of the driving signal.

An automatic playing system independent of a piano has been proposed for standard acoustic pianos. The automatic playing system makes it possible to enjoy music tunes performed on the standard acoustic piano without any fingering. Thus, the automatic playing system offers automatic performances to users, who have already put acoustic pianos in their houses.

A typical example of the automatic playing system is disclosed in Japanese Patent Application laid-open No. 2005-309024. The prior art automatic playing system is broken down into three parts, i.e., a key driving unit, a pedal driving unit and a controlling unit. The key driving unit, pedal driving unit and controlling unit are provided on a movable frame structure, and an array of solenoid-operated key actuators and an array of solenoid-operated pedal actuators are incorporated into the key driving unit and pedal driving unit, respectively.

When a user wishes to enjoy the automatic performance on his or her acoustic piano, he or she moves the frame structure to a place in front of the acoustic piano. Then, the key driving unit is provided over the front portions of the black keys and the front portions of the white keys and the pedal driving unit is provided over the damper, soft and sostenuto pedals. The solenoid-operated key actuators and solenoid-operated pedal actuators are directed in the downward direction, and the pushers, which are connected to the plungers, are in close proximity to the upper surfaces of the front portions of black and white keys and the upper surfaces of the three pedals.

A position adjuster is provided between the frame structure and the key driving unit so that a user locates the tips of plungers to proper positions with respect to the keyboard by manipulating the position adjuster. On the other hand, universal joints are provided between the plungers and the pushers so that the universal joints take up misalignment between the solenoid-operated pedal actuators and the three pedals, if any.

While music data codes are being sequentially processed in the controlling unit, the driving signals are selectively supplied from the controlling unit to the solenoid-operated key actuators and solenoid-operated pedal actuators. The solenoid-operated key actuators depress the black keys and white keys with the pushers, and the solenoid-operated pedal actuators move the three pedals to target pedal positions.

A problem is encountered in the prior art automatic playing system in that the users feel the reproduced tunes less resemble than the tunes produced through the automatic player pianos.

SUMMARY OF THE INVENTION

It is therefore an important object of the present invention to provide a automatic playing system, which reproduces performances at high fidelity regardless of models of acoustic pianos.

It is also an important object of the present invention to provide a computer program used in the automatic playing system.

The present inventor contemplated the problem inherent in the prior art automatic playing system, and noticed that music tunes were reproduced on the basis of control parameters obtained through experiments on a particular model of acoustic piano. There were various sorts of time lag, resistances against movements of component parts and offset voltage in sensors. For example, the collision between the hammers and the strings was delayed from the initiation of the music data code in the controlling unit, and the solenoid-operated key actuators exhibited their own electric current-to-output force characteristics. The hammers of a certain model of acoustic piano were different in weight from those of another model of acoustic piano, and the action units of the certain model of acoustic piano had their own structure different from those of yet another model of acoustic piano. The offset voltage was inherent in some sorts of electronic components. The control parameters were prepared in the controlling system so as to conquer the time lags, resistances and offset voltages.

The built-in automatic playing system, which had been already installed in an automatic player piano, was expected to drive the particular component parts of the only one acoustic piano. The manufacturer prepared the control parameters through experiments on an acoustic piano of the same model, and stored the control parameters in the non-volatile memory of the controlling unit. Thus, it was not difficult to prepare the control parameters for the built-in automatic playing system.

On the other hand, the automatic playing system was expected to perform music passages on various sorts of acoustic pianos. It was impossible for the manufacturers to specify the models of acoustic pianos. In this situation, the manufacturer prepared the control parameters through experiences on a certain acoustic piano on which the automatic playing system would possibly perform music tunes. Although the control parameters were appropriate only for the certain acoustic piano, they were not always applicable to other models of acoustic pianos.

It was feasible for the manufacturers to prepare a lot of sets of control parameters for all the possible models of acoustic pianos. The present inventor concludes that a self-teaching function is to be given to a controlling unit.

To accomplish the object, the present invention proposes to tailor control parameters optimum to a musical instrument combined with an automatic playing system.

In accordance with one aspect of the present invention, there is provided an automatic playing system for producing tones through a musical instrument on the basis of a set of music data codes, and the automatic playing system comprises an array of actuators responsive to a driving signal so as to move manipulators of the musical instrument for producing the tones, a sensor system for converting an attribute of the tones to a detecting signal expressing a quantity of the attribute and a controlling unit connected to the array of actuators and the sensor system, preparing control parameters optimum to the musical instrument and defining relation between pieces of music data stored in the music data codes and expressing the quantity of the attribute of tone to be produced and pieces of control data used in adjustment of the driving signal to a magnitude on the basis of the detecting signal and the driving signal adjusted to testing magnitudes before an automatic playing and producing the driving signal on the basis of the music data codes and the control parameters in the automatic playing.

In accordance with another aspect of the present invention, there is provided a computer program expressing a method of preparing control parameters for a musical instrument, and the method comprises the steps of a) supplying a driving signal adjusted to a testing magnitude to an actuator provided in association with a manipulator of the musical instrument so as to drive the manipulator for producing a tone, b) analyzing a detecting signal expressing an attribute of the tone for determining relation between a quantity of the attribute and the testing magnitude, c) changing the driving signal from the testing magnitude to another testing magnitude for receiving the detecting signal, d) repeating the steps b) and c) so as to determine relation between the testing magnitudes and the quantity of the attribute and e) analyzing the relation between the testing magnitudes and the quantity of the attribute for preparing the control parameters optimum to the musical instrument and defining relation between pieces of music data stored in music data codes used in an automatic playing and expressing the quantity of the attribute and pieces of control data used in adjustment of the driving signal to a magnitude appropriate to production of tones respectively having quantities of the attribute indicated by the pieces of music data.

BRIEF DESCRIPTION OF THE DRAWINGS

The features and advantages of the automatic playing system and computer program used therein will be more clearly understood from the following description taken in conjunction with the accompanying drawings, in which.

DESCRIPTION OF THE PREFERRED EMBODIMENTS

Figure 1:
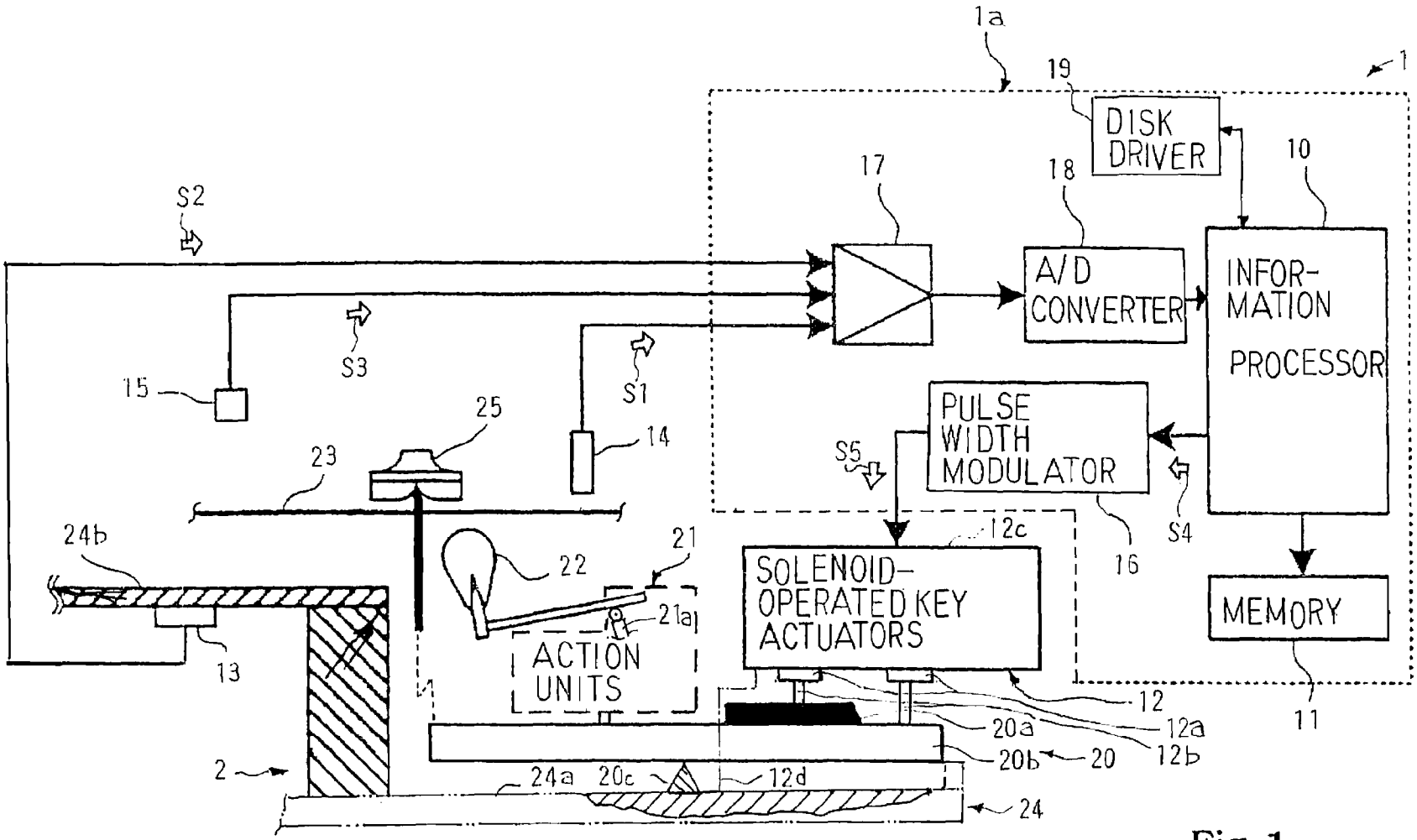
FIG. 1 is a schematic side view showing an automatic playing system and a grand piano.

An automatic playing system embodying the present invention is used for a musical instrument, and largely comprises an array of actuators, a sensor system and a controlling unit. The controlling unit is connected to the array of actuators and sensor system through cables, and has an information processing capability. The information processing capability is realized through execution of a computer program.

When the automatic playing system is combined with the musical instrument, the actuators are respectively associated with manipulators of the musical instrument. The manipulators are used for producing tones along a music passage. An attribute of tones Such as loudness is varied in dependence on the movements of manipulators, i.e., a fast movement or a slow movement. In an automatic playing, the controlling unit adjusts a driving signal to a proper magnitude, and supplies the driving signal to the actuators associated with the manipulators to be moved at proper timing.

The automatic playing system is responsive to a set of music data codes. Plural sorts of music data are stored in the music data codes. A sort of music data codes is used for production of a tone through the musical instrument, and pieces of music data stored therein express one of the manipulators to be moved, a quantity of attribute of the tone and so forth. While a music data code of the sort is being processed, the controlling unit determines the manipulator to be moved, magnitude of the driving signal, proper timing and so forth. However, the piece of music data does not directly express the magnitude of driving signal. Therefore, the quantity of attribute is to be translated to the magnitude of driving signal. Control parameters are used for the translation between the quantity of attribute and pieces of control data expressing the magnitude of driving signal, proper timing or both of the magnitude and proper timing. The pieces of control data are dependent on the sort of musical instrument. In case where the time lag is ignoreable it is not necessary to define the relation between the quantity of attribute and the time lag. Similarly, in case where the magnitude of driving signal does not have any inference of the attribute, it is not necessary to define the relation between the quantity of attribute and the magnitude of driving signal.

The controlling system tailors the control parameters through a self-teaching with the assistance of the sensor system before the automatic playing. The attribute of tones are converted to a detecting signal expressing the quantity of attribute. Since the detecting signal is varied through the behavior of the musical instrument, individualities of the musical instrument have influences on the detecting signal. For this reason, the control parameters are tailored for the musical instrument, and, accordingly, are optimum to the musical instrument.

In the test-teaching, the controlling unit adjusts the driving signal to a test magnitude, and supplies the driving signal to one of the actuators. The actuator gives rise to the movement of the associated manipulator and the tone is produced in the musical instrument, and the detecting signal, which expresses a quantity of the tone, is produced in the sensor system. The detecting signal is supplied to the controlling system so that the controlling system makes the test magnitude paired with the quantity of attribute. The controlling unit changes the driving signal to the test magnitude to another test magnitude, and the sensor system supplies the detecting signal to the controlling unit so as to make it possible to pair another test magnitude to the quantity of attribute. Thus, the controlling unit repeats the above-described sequence, and accumulates the pairs of test magnitudes and the quantities of attribute. Finally, the controlling unit determines the relation between the pieces of music data expressing the attribute and pieces of control data for driving the actuators. The pieces of control data express the magnitude of driving signal, proper timing or both of the magnitude and proper timing.

As will be understood from the foregoing description, the control parameters are prepared through the experiments on the musical instrument combined with the automatic playing system. When the automatic playing system is combined with another musical instrument, new control parameters are prepared for the new musical instrument, and the individualities of new musical instrument are taken into the new control parameters. Thus, the control parameters are optimum to the musical instrument combined with the automatic playing system. The control parameters make it possible to reproduce a performance on the musical instrument at high fidelity.

First Embodiment

Referring to FIG. 1 of the drawings, an automatic playing system 1 embodying the present invention is combined with a grand piano 2. Since the automatic playing system 1 is physically independent of the grand piano 2, it is possible to combine the automatic playing system 1 with other models of acoustic pianos. In other words, the automatic playing system 1 is portable. Pieces of music are played on the grand piano 2 by means of the automatic playing system 1 instead of a human player, and the automatic playing system I adjusts control parameters to values appropriate to the grand piano 2 through a self-teaching.

The grand piano 2 comprises a keyboard 20, action units 21, hammers 22 strings 23, piano cabinet 24 and dampers 25. The keyboard 20 includes black keys 20*a* and white keys 20*b* and a balance rail 20*c*, and the total number of the black and white keys 20*a* and 20*b* are eighty-eight. Pitch names are respectively assigned to the black and white keys 20*a*/20*b* so that a pianist specifies the pitch of acoustic tones by means of the black and white keys 20*a*/20*b*. A key bed 24*a* forms a part of the piano cabinet 24*a*, and the balance rail 20*c* extends in the lateral direction on the key bed 24*a*. The balance rail 20*c* offers fulcrums to the black keys 20*a* and white keys 20*b* so that the black keys 20*a* and white keys 20*b* independently pitch up and down. When a pianist depresses the front portions of the black and white keys 20*a*/20*b*, the front portions are sunk, and the black and white keys 20*a*/20*b* start to travel from rest positions toward end positions.

The dampers 25 are respectively linked with the black and white keys 20*a*/20*b* so that the black and white keys 20*a*/20*b* give rise to up-and-down movements of the dampers 25. While the black and white keys 20*a*/20*b* are staying at the rest positions, the dampers 25 are held in contact with the associated strings 23, and prevent the associated strings 23 from vibrations. The dampers 25 leave from the strings 23 on the way of associated keys 20*a*/20*b* toward the end positions, and allow the strings 23 to vibrate.

The action units 21 are respectively linked with the black and white keys 20*a*/20*b*, and are actuated by the depressed keys 20*a*/20*b*. While the black and white keys 20*a*/20*b* are staying at the rest positions, the action units 21 are held in contact with the hammers 22 at the heads of jacks 21*a*. When the jacks 21*a* escape from the association hammers 22, the hammers 22 start to rotate toward the associated strings 23. The strings 23 are designed to vibrate at predetermined values of frequencies equivalent to the pitch names assigned to the associated black and white keys 20*a*/20*b*. The hammers 22 are brought into collision with the strings 23 at the end of the rotation, and give rise to the vibrations of strings 23.

A soundboard 24*b* forms another part of the piano cabinet 24, and the strings 23 extend over the soundboard 24*b*. While the strings 23 are vibrating, the vibrations are propagated to the soundboard 24*b*, and the soundboard 24*b* resonates with the vibrating strings 23. Thus, the piano tones are amplified through the resonance of the soundboard 24*b*, and are radiated from the grand piano 2.

The automatic playing system 1 comprises a controlling unit 1*a*, a key driver unit 12 and loudness sensors, i.e., vibration sensors 13 and 14 and a microphone 15. The vibration sensors 13 and 14 are provided in association with the strings 23 and soundboard 24*b*, and the vibrations of strings 23 and the vibrations of soundboard 24*b* are converted to an analog string vibration signal S1 and an analog board vibration signal S2, respectively. The microphone 15 is provided inside of the piano cabinet 24, and the sound waves of the acoustic piano tones are converted to an analog loudness signal S3. The vibration sensors 13/14 and microphone 15 are connected to the controlling unit 1*a* so that the analog string vibration signal S1, analog board vibration signal S2 and analog loudness signal S3 are supplied to the controlling unit 1*a*. The vibration sensors 13/14 and microphone 15 are detachable from the grand piano 2 so as to be temporarily installed in the grand piano 1 for the self-teaching.

The key driver unit 12 is provided over the keyboard 20, and includes solenoids 12*a*, plungers 12*b*, a casing 12*c* and an adjusting mechanism 12*d*. The solenoids 12*a* are arranged in a staggered fashion, and are supported by the casing 12*c*. The plungers 12*b* are directed to the downward direction, and are projectable from and retractable into the solenoids 12*a*, respectively. The plungers 12*b* are spaced from the adjacent plungers 12*b* at pitches equal to the pitches of the black and white keys 12*a* and 12*b* so as to be aligned with the associated black and white keys 20*a*/20*b*, respectively. The adjusting mechanism 12*d* is associated with the casing 12*c*, and a user adjusts the casing 12*c* to optimum height at which the plungers 12*b* are in the close proximity to the upper surfaces of the black and white keys 20*a*/20*b* as described in the above-mentioned Japanese Patent Application laid-open.

The controlling unit 1*a* includes an information processor 10, a memory 11, a pulse width modulator 16, an amplifier 17, an analog-to-digital converter 18 and a disk driver 19. Though not shown in FIG. 1, the controlling unit 1*a* further includes a manipulating panel, a panel display and interfaces. The information processor 10, memory 11, pulse width modulator 16, amplifier 17, analog-to-digital converter 18 and other system components such as, for example, signal interfaces are mounted on a circuit board (no shown), and the information processor 10, memory 11, pulse width modulator 16, amplifier 17, analog-to-digital converter 18, disk driver 19 and other system components are connected to one another through a conductive pattern of the circuit board.

The information processor 10 is an origin of the data processing capability of the controlling unit 1*a*, and is implemented by a monolithic microcomputer. The monolithic microcomputer has a central processing unit, i.e., an arithmetic and logic unit and a control unit, a read only memory serving as a program memory, a random access memory serving as a working memory, signal buffers and a shared bus system. A computer program is stored in the read only memory, and runs on the central processing unit so as to accomplish jobs. The automatic playing and self-teaching are realized through the jobs.

The control parameters are stored in the memory unit 11 in the form of tables. In this instance, an electrically erasable and programmable memory such as a flash memory is used as the memory 11. Other sorts of memory devices such as semiconductor random access memories are available for the tables.

The pulse width modulator 16 is responsive to a control signal S4, which is supplied from the information processor 10, so as to adjust a driving pulse signal S5 to a value of duty ratio, and the driving signal S5 is supplied to the solenoid 12*a* associated with the black/white key 20*a*/20*b* to be driven.

The analog string vibration signal S11 analog board vibration signal S2 and analog loudness signal S3 are input to the amplifier 17. A mixer is built in the amplifier 17, and the analog string vibration signal S1 analog board vibration signal S2 and analog loudness signal S3 are mixed into an analog test signal, and the amplitude of the analog test signal is increased through the amplifier 17. The amplifier 17 is connected to the analog-to-digital converter 18.

The analog test signal is converted to a digital test signal through the analog-to-digital converter 18, and the digital test signal is supplied to the signal input buffer of information processor 10.

In this instance, a hard disk driver and a hard disk serve as the disk driver 19. Standard MIDI (Musical Instrument Digital Interface) files are stored in the disk driver 19, and a set of music data codes is held in the data chunk of each standard MIDI file. A performance on a music tune is expressed by a set of music data codes. The note-on events and note-off events stand for the depressed keys and released keys in the performance, and are specified with pieces of note-on event data, which are stored in note-on data codes, pieces of note-off event data, which are stored in note-off data codes, and pieces of duration data, which are stored in delta time codes.

The note-on data code contains a status byte indicative of the note-on event and a MIDI channel number and data bytes indicative of the key number assigned to the black/white key 20*a*/20*b* to be depressed and velocity expressing final hammer velocity or loudness of the tone to be produced. The 8-bit data byte makes it possible to express 128 gradations of loudness.

The note-off data code contains a status byte indicative of the note-off event and MIDI channel number and a data byte indicative of the key number assigned to the black/white key 20*a*/20*b* to be released and a data byte indicative of the key number assigned to the black/white key 20*a*/20*b* to be released.

The delta time code is indicative of the lapse of time from the previous note-on event or note-off event.

The vibration sensor 13 is implemented by only one piezoelectric element, and is provided on the soundboard 24*b*. In this instance, the vibration sensor 13 is adhered to the soundboard 24*b* by means of a piece of pressure sensitive adhesive double-coated tape. The piezoelectric element and pressure sensitive adhesive double-coated tape are economical so that the cost for the self-teaching is low.

The vibrations of soundboard give rise to the stress of the piezoelectric element, and the piezoelectric element converts the stress to the analog board vibration signal S2. The vibration sensor 13 varies the amplitude of board vibration signal depending upon the amount of stress so that the analog board vibration signal S2 is representative of the vibrations of soundboard 24*b*.

The string vibration sensor 14 is implemented by plural electromagnetic pickup devices. In this instance, three electromagnetic pickup devices are provided for the strings 23 of a lower register, strings 23 of a middle register and strings 23 of a higher register. The electromagnetic pickup devices are provided in the vicinity of the string groups, respectively, and convert the vibrations of strings 23 to the analog string vibration signal S1.

The microphone 15 is provided over the soundboard 24*b* and the sound waves from the soundboard 24*b* are converted to the analog board vibration signal S3. Although the microphone 15 is provided over the soundboard 24*b*, a microphone under the soundboard 24*b* may be preferable to the microphone 15 over the soundboard 24*b* from the viewpoint that noise is to be reduced.

Figure 2:
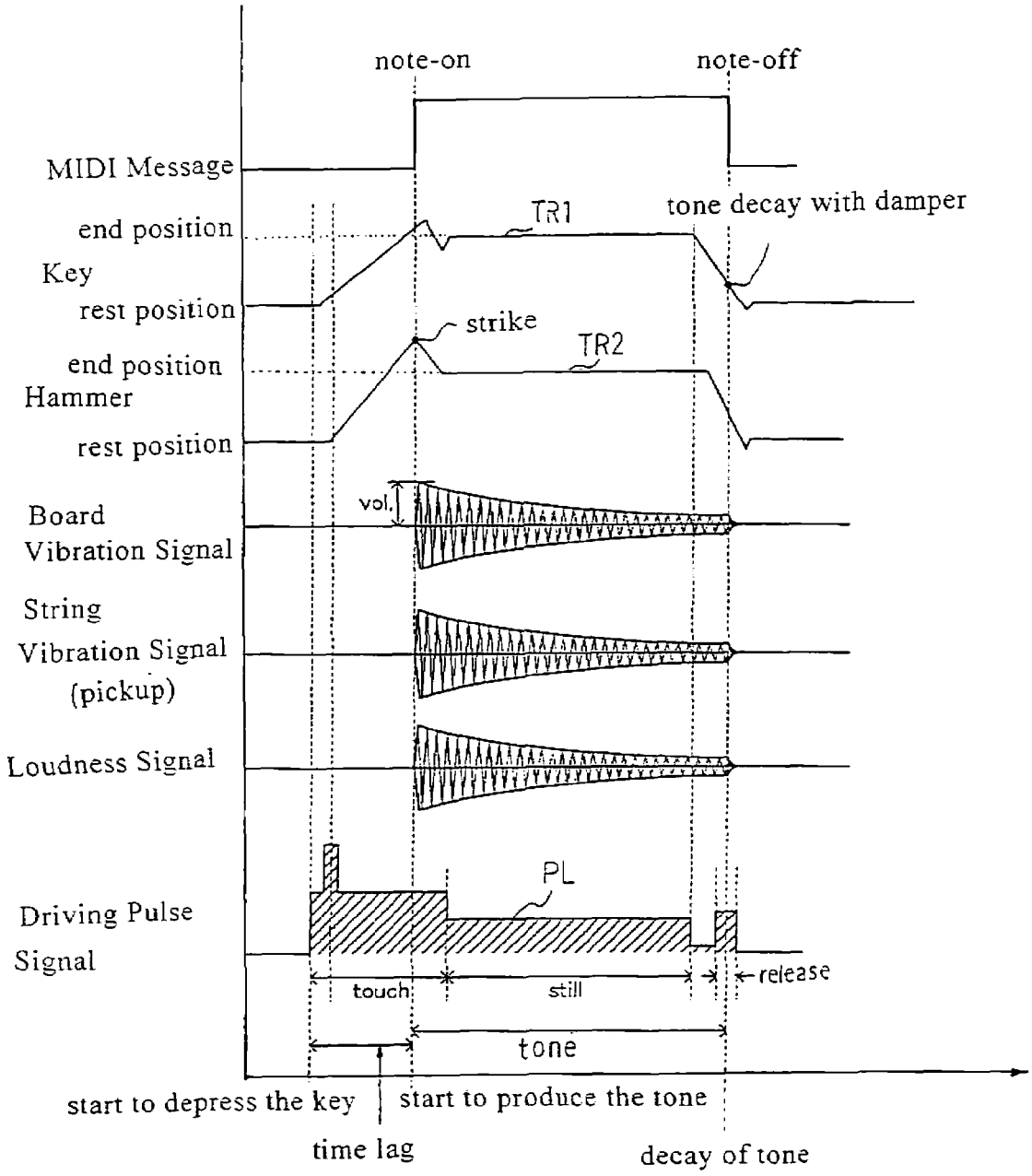
FIG. 2 is a timing chart showing relation among MIDI messages, a key movement, a hammer motion, output signals of sensors and a driving pulse signal.

Turning to FIG. 2 of the drawings, relation among the MIDI messages, key movement, hammer movement, output signals S1, S2 and S3 and driving pulse signal S5 is illustrated. Assuming now that a black/white key 20*a*/20*b* is moved between the rest position and the end position along a key trajectory TR1, the hammer 22 is driven to travel on a hammer trajectory TR2. The note-on message is delivered at the timing to strike the string 23 with the hammer 22, and the note-off message is delivered at the timing to bring the damper 25 into contact with the vibrating string 23.

When the string 23 is struck with the hammer 22, the string 23 starts to vibrate, and the acoustic piano tone is produced through the resonance of the soundboard 24*b* with the string 23. The board vibration signal S2, string vibration signal S1 and loudness signal S3 are output from the vibration sensors 13 and 14 and microphone 15, and the envelops of signals S1 to S3 stand for variation of the loudness of acoustic piano tone.

In order to make the black/white key 20*a*/20*b* move along the key trajectory TR1, the controlling unit 1*a* energizes the solenoid 12*a* of associated solenoid-operated key actuator with the driving pulse signal S5. The driving pulse signal S5 varies the potential level as indicated by plots PL. The amplitude of the driving pulse signal S5 is proportional to the amount of current flowing through the solenoid 12*a*.

The driving pulse signal S5 is divided into three periods, which are called as "touch", "still" and "release". The amplitude of driving pulse signal S5 is proportional to the amount of current and, accordingly, to the force exerted on the black and white keys 20*a*/20*b*. While the driving pulse signal S5 is being found in the period "touch", the magnetic field around the solenoid 12*a* exerts the magnetic force on the plunger 12*b*, and the plunger 12*b* causes the black/white key 20*a*/20*b* to pass a reference point on the key trajectory TR1 at a reference time at reference key velocity. The key movement results in the collision between the hammer 22 and the string 23 at the time "note-on". Since the reference key velocity is proportional to the final hammer velocity, which in turn is proportional to the loudness of the acoustic piano tones the controlling unit 1*a* produces the acoustic piano tone at the loudness equal to that expressed by the music data code by controlling the driving pulse signal S5 in the period "touch". Since the driving pulse signal S5 temporarily becomes higher at an early stage of the period "touch", the plunger 12*b* overcomes the heavily load due against the initiation of plunger movement. The mean amplitude in the period "touch" is equivalent to the force exerted on the black and white keys 20*a*/20*b* in the key movements on the reference key trajectories.

The driving pulse signal S5 causes the plunger 12*b* to keep the black/white key 20*a*/20*b* at the end position in the next period "still" so that the string 23 continues to vibrate.

The period "release" is provided for the note-off event. As described in conjunction with the damper 25, the acoustic piano tone is decayed at the recover to the contact between the damper 25 and the vibrating string 23. Accordingly, the plunger 12*b* controls the key movement after the release so as to make the black/white key 20*a*/20*b* to bring the damper 25 into contact with the vibrating string 23 at the time to decay the acoustic piano tone.

The acoustic piano tone is produced at the time to "start to produce the tone", and the time to "start to produce the tone" is found at the collision between the hammer 25 and the string 23. Then, the string vibration signal S1, board vibrating signal S2 and the loudness signal S3 rapidly rise. The string vibration signal S1, board vibration signal S2 and loudness signal S3 are rapidly decayed at the recover to the contact between the damper 25 and the vibrating string 23. From the envelopes of signals S1, S2 and S3, it is understood that the amplitude peaks immediately after the collision between the hammer 22 and the string 23. The controlling unit 1*a* holds the peak value, and determines the loudness of the acoustic piano tone.

Description is hereinafter made on the computer program. The computer program is broken down into a main routine program and subroutine programs. One of the subroutine programs is assigned to the automatic playing, and the self-teaching is accomplished through execution of another subroutine program.

Figure 3:
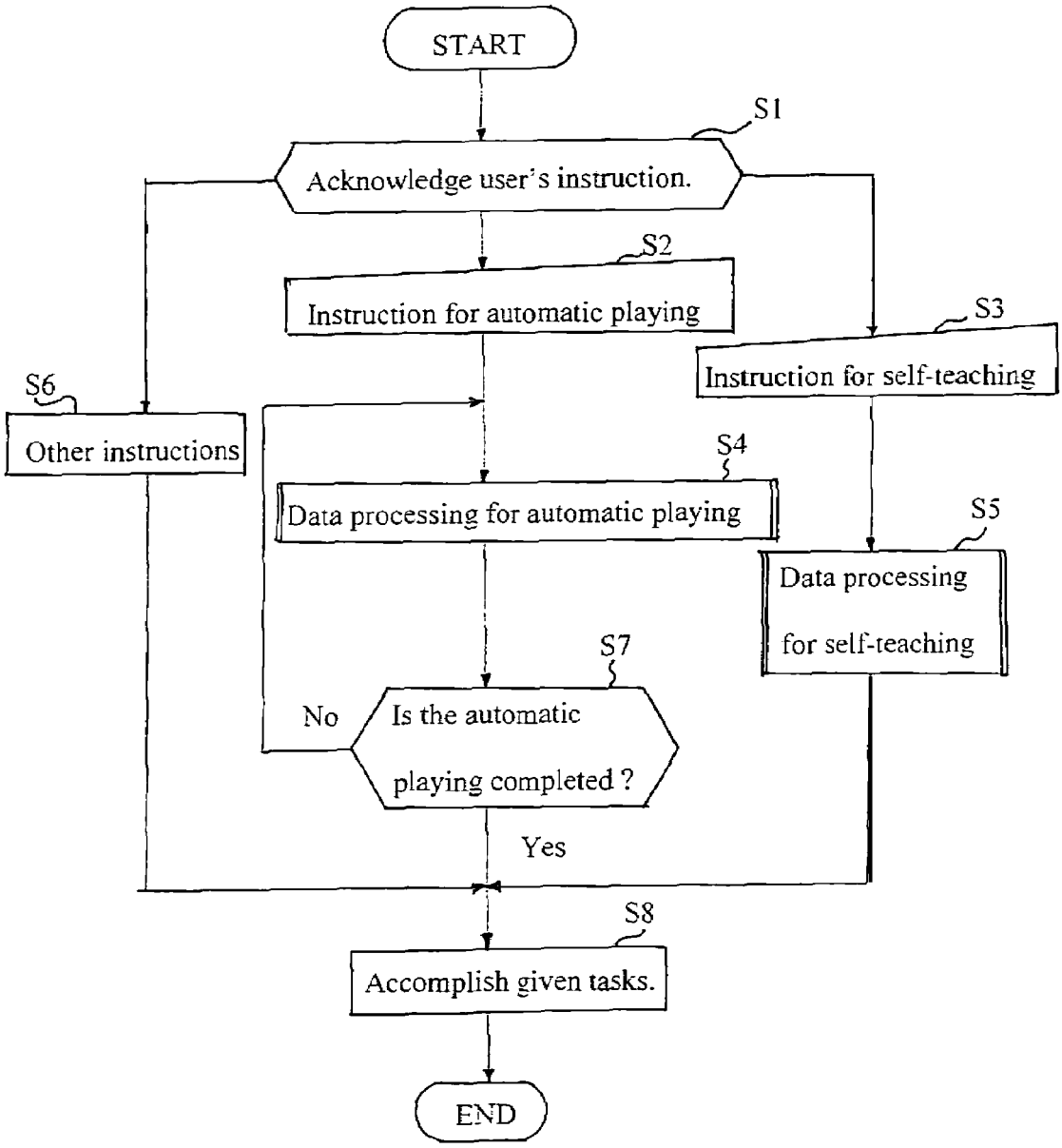
FIG. 3 is a flowchart showing a job sequence in a main routine program forming a part of a computer program loaded in a controlling unit.

FIG. 3 illustrates the main routine program. When a user turns on a power switch on the manipulating board (not shown) of the controlling unit 1*a*, the main routine program starts to run on the information processor 10. After the system initialization, the information processor 10 periodically checks the signal interface assigned to the manipulating board (not shown) to see whether or not a user gives an instruction. While any instruction is being not found at the signal interface, the information processor 10 repeats the check at the signal interface.

The user is assumed to give an instruction. The information processor 10 acknowledges the instruction as by step S1, and interprets the instruction as by step S2 or S3.

When the user instructs the automatic playing system to reenact a performance expressed by a set of music data code, the information processor 10 admits that user instructs the automatic playing as by step S2, and the main routine program starts periodically to branch to the subroutine program S4.

The set of music data codes is transferred from the memory device 11 to the random access memory of the information processor 10, and the information processor 10 behaves in the automatic playing as follows. The information processor 10 seeks a music data code or codes indicative of a tone or tones to be immediately processed. The delta time codes make it possible to find the music data code or codes.

The information processor 10 is assumed to find a music data code to express a tone to be immediately produced. Then, the information processor analyzes the piece of music data stored in the music data code, and determines details of the note-on event such as, a time to start the forward key movement from the rest position, a reference key trajectory, which is a series of values of target key positions varied with time, and the reference key velocity. When the time to start the key movement comes, the information processor 10 periodically supplies the first value of the target key position to the pulse width modulator 16. The pulse width modulator 16 adjusts the driving pulse signal S5 to a value of the duty ratio corresponding to the target force to be applied to the black/white key 20*a*/20*b*. The solenoid 12*a* creates the magnetic field, and causes the plunger 12*b* to project in the upward direction. The plunger 12*b* exerts the target force on the rear portion of the black/white key 20*a*/20*b*, and gives rise to the forward key movement toward the end position. The black/white key 20*a*/20*b* actuates the associated action unit 21.

The information processor 10 periodically supplies the values of target position to the pulse width modulator 16, and the pulse width modulator 16 modifies the mean current of the driving pulse signal, if necessary. Thus, the information processor 10 forces the black/white key 20*a*/20*b* to travel on the reference key trajectory with the assistance of the pulse width modulator 16 and solenoid-operated key actuator 12*a*/12*b*, and makes the black/white key 20*a*/20*b* to pass through the reference point at the reference key velocity.

The black/white key 20*a*/20*b* drives the hammer 22 through the associated action unit 21 for rotation toward the string 23. As described hereinbefore, the reference key velocity is proportional to the final hammer velocity. Since the information processor 10 controls the solenoid-operated key actuator 12*a*/12*b* through the pulse width modulator 16 in such a manner that the black/white key 20*a*/20*b* passes through the reference point on the reference key trajectory at the reference key velocity, the hammer 22 is brought into collision with the string 23 at the target value of the final hammer velocity, and makes the string 23 to produce the acoustic piano tone at the loudness same as that of the tone expressed by the music data code.

The automatic playing system repeats the above-described control sequence for the acoustic piano tones expressed by the music data codes, and reenacts the performance on the grand piano 2.

The information processor 10 continues to check the signal interface for user's instruction, and determines whether or not the automatic playing is completed as by step S7. While the automatic playing is being continued, the answer at step S7 is given negative "No". With the negative answer, the information processor 10 returns to step S4. Thus, the information processor 10 reiterates the loop consisting of steps S4 and S5, and reenacts the performance through the execution of music data codes.

When the user turns on the switch for completion of the automatic playing, the answer at step S7 is given affirmative "Yes". Then, the information processor 10 proceeds to step S8.

When the user instructs the automatic playing system to carry out the self-teaching, the information processor 10 admits that the user instructs to carry out the self-teaching as by step S3, and the main routine program periodically branches to the subroutine program S5 for the self-teaching. Upon completion of the self-testing, the information processor 10 proceeds to step S8.

When the user gives other instructions, the information processor 10 carries out the given tasks as by step S6. Upon completion of the tasks, the information processor 10 proceeds to step S8.

The information processor 10 accomplishes the tasks given by the user at step S8 on the condition that the user turns off the power switch, by way of example, and terminates the data processing.

Assuming now that a worker or a user instructs the self-teaching to the controlling unit 1*a* through the manipulating panel (not shown), the main routine program starts periodically to branch to the subroutine program S5 for the self-teaching.

Figure 4:
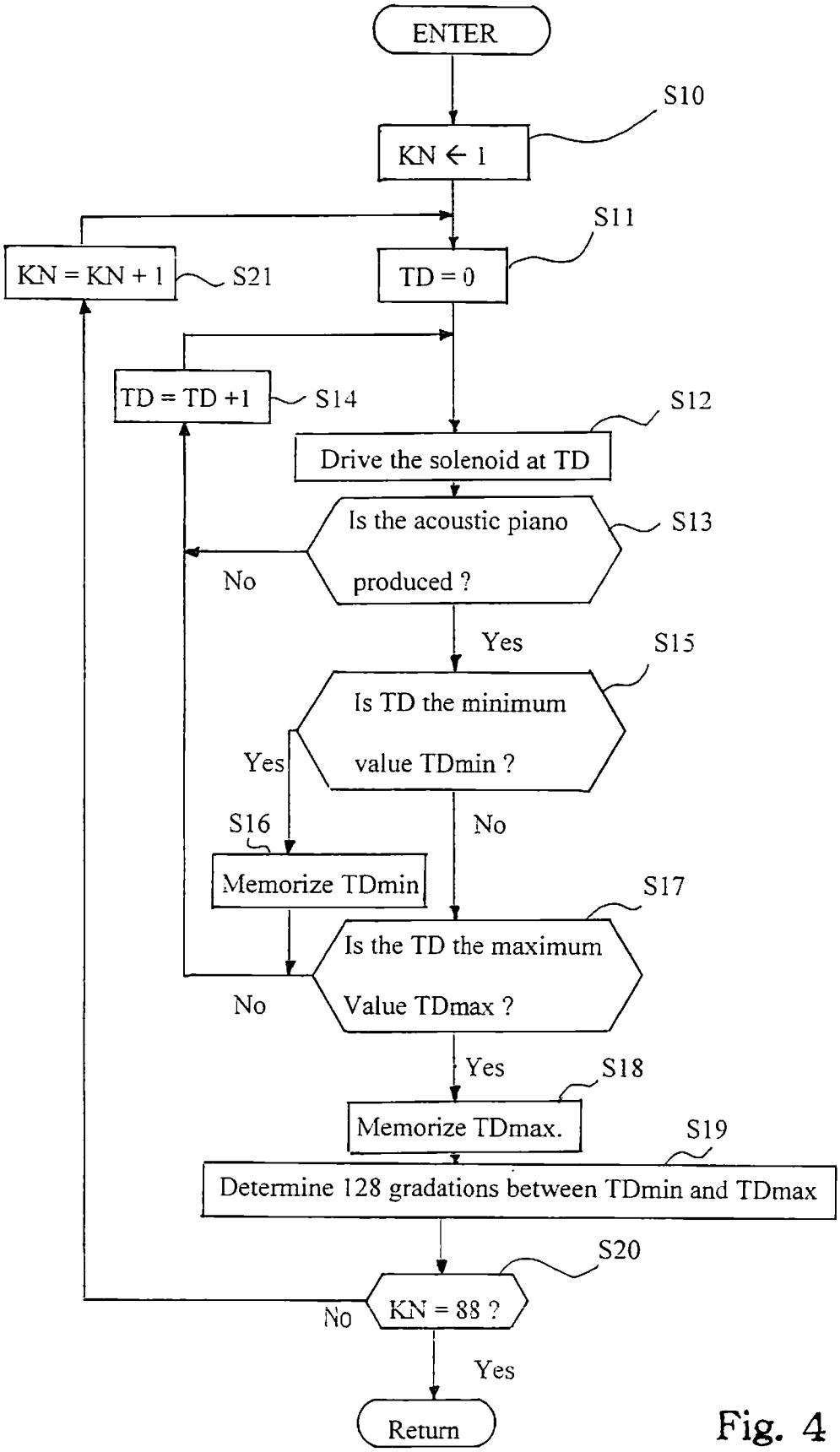
FIGS. 4 to 6 are flowcharts showing job sequences executed in a self-teaching.
Figure 5:
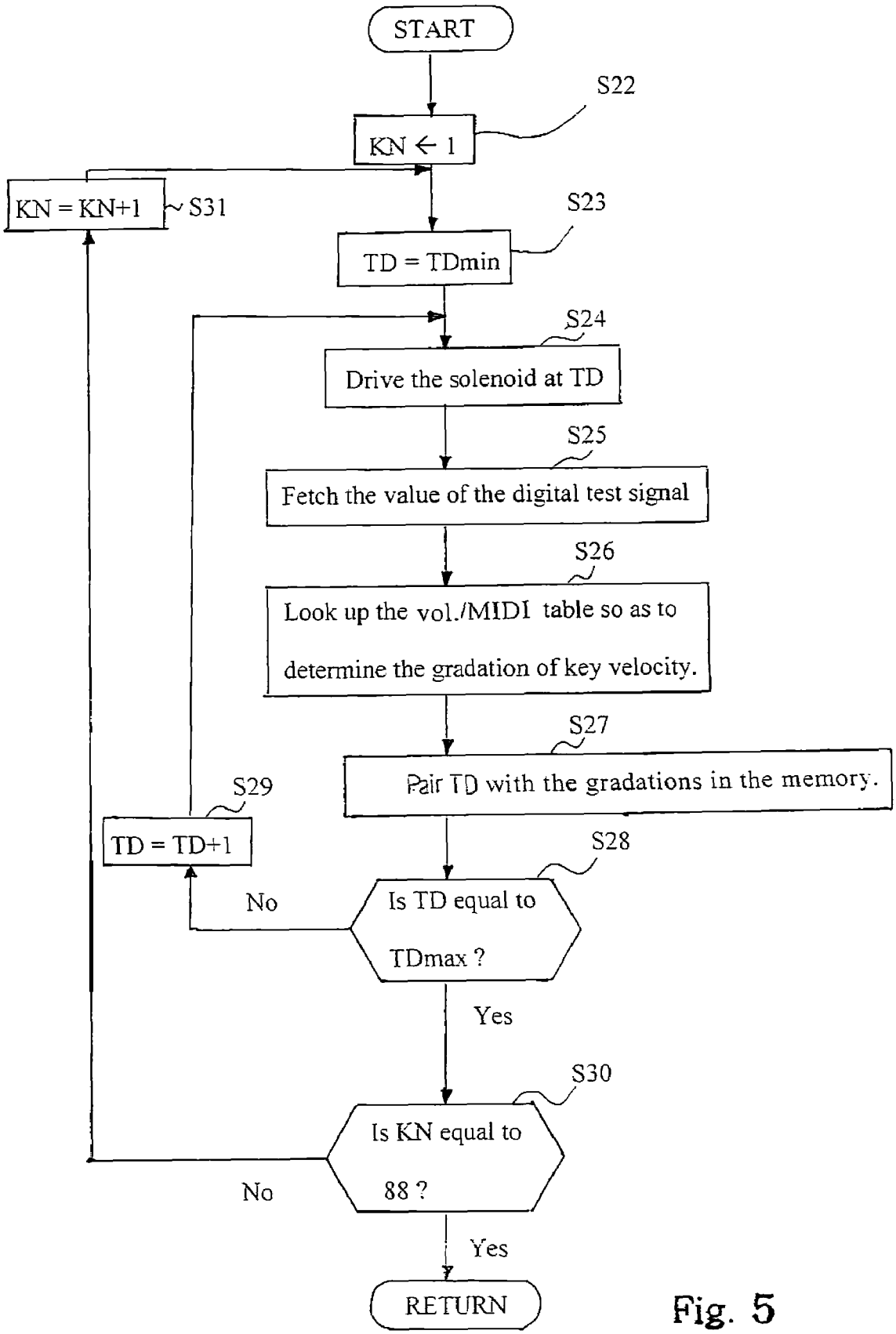
Figure 6:
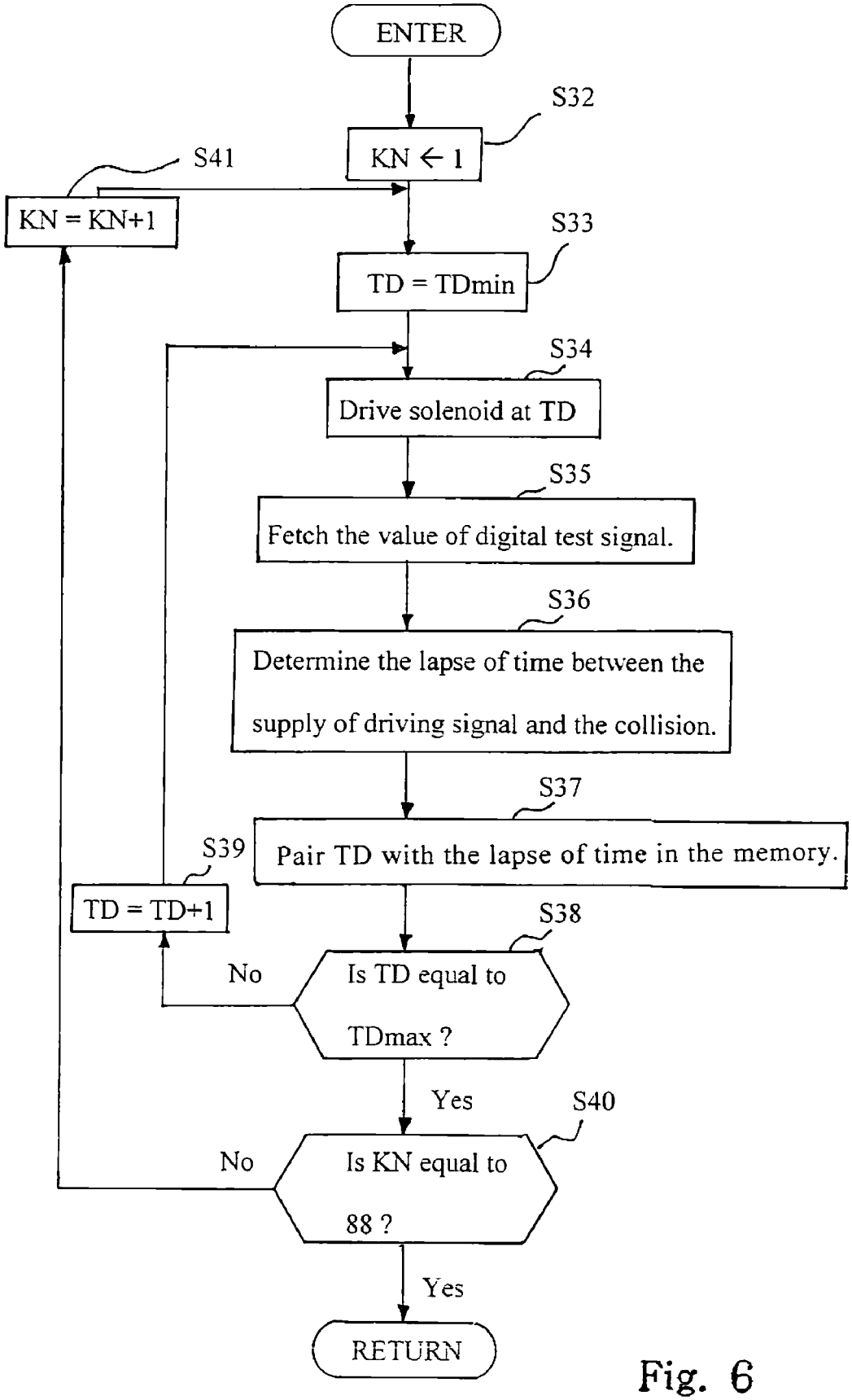

FIGS. 4, 5 and 6 illustrate job sequences in the subroutine program S5. Three control tables are prepared through the self-teaching. In the following description, 128 gradations of key velocity defined in the MIDI protocols are referred to as "values of MIDI velocity". As described hereinbefore in conjunction with FIG. 2, the force exerted on the black and white keys 20*a*/20*b* is expressed by the amplitude of driving pulse signal S5. In case where the black and white keys 20*a* and 20*b* take the uniform motion on the reference trajectories, the amplitude in the touch period is proportional to the reference key velocity, which in turn is proportional to the final hammer velocity, so that the amplitude is proportional to the loudness of acoustic piano tones. The amplitude in the touch period is hereinafter labeled with "TD (Touch Data)".

The first table defines a relation between the dynamic range and the MIDI velocity, and is prepared through a subroutine program illustrated in FIG. 4. The second table defines a relation between the amplitude of the driving pulse signal TD and the MIDI velocity, and is prepared through a subroutine program illustrated in FIG. 5. The third table defines the amplitude TD of driving pulse signal S5 and time lag between a start time to energize the solenoids 12*a* and a time at which the hammers 22 are brought into collision with the associated strings 23, and is prepared through a subroutine program illustrated in FIG. 6.

Assuming flow that a user or a worker instructs the controlling unit 1*a* to prepare the three tables through the self-teaching, the main routine program starts periodically to branch to the subroutine program S5. The information processor 10 firstly enters the subroutine program shown in FIG. 4, and sets the key number KN, which expresses one of the black and white keys 20*a*/20*b*, to 1 as by step S10, and requests the pulse width modulator 16 to adjust the driving pulse signal S5 to the minimum value corresponding to gradation 0 of the MIDI velocity in a standard MIDI-TD table.

Subsequently, the information processor 10 requests the pulse width modulator 16 to supply the driving pulse signal S5 to the solenoid 12*a* associated with the white key 20*b* assigned the key number "1" as by step S12. The solenoid 12*a* is energized with the driving pulse signal S5, and the plunger 12*b* causes the white key 20*b* to be moved from the rest position toward the end position. The key movement gives rise to the rotation of hammer 22 through the action unit 21. If the force is large enough to rotate the hammer 22 for rotation, the hammer 22 is brought into collision with the string 23, and the acoustic piano tone is produced through the vibration of the string 23. However, if not, the hammer 22 does not reach the string 23, and the acoustic piano tone is not produced.

The information processor 10 checks the signal input buffer to see whether or not the digital test signal exceeds the threshold indicative of the generation of the acoustic piano tone as by step S14. If the acoustic piano tone has not been produced, the answer is given negative "No". Then, the information processor 10 increments the amplitude TD by one as by step S14, and returns to step S12. Thus, the information processor 10 reiterates the loop consisting of steps S12, S13 and S14 so as to find the digital test signal exceeding over the threshold.

When the information processor 10 finds the digital test signal exceeding the threshold, the information processor 10 acknowledges that the solenoid-operated key actuator 12*a*/12*b* causes the white key 20*b* and associated action unit 21 to bring the hammer 22 into collision with the string 23, and the answer at step S13 is changed to affirmative "Yes".

With the positive answer, the information processor 10 checks the register assigned to the amplitude TD to see whether or not the present value of amplitude TD is less than the previous value, i.e., minimum value TDmin as by step S15. If the answer at step S15 is affirmative "Yes", the information processor 10 memorizes the present value in the register assigned to the minimum amplitude TDmin. Upon completion of the job at step S16, the information processor 10 increments the amplitude TD at step S14, and returns to step S12. Thus, the information processor 10 reiterates the loop consisting of steps S12 to S16 so as to determine the minimum amplitude TDmin at which the solenoid-operated key actuator 12*a*/12*b* makes the hammer 22 brought into collision with the string 23.

On the other hand, when the present value of amplitude TD is equal to or greater than the minimum amplitude TDmin, the answer at step S15 is given negative "No". Then, the information processor 10 compares the present value of amplitude TD with the maximum amplitude TDmax to see whether or not the driving pulse signal S5 reaches the maximum amplitude TDmax as by step S17. The maximum amplitude TDmax is defined in the specification of solenoid-operated key actuators 12*a*/12*b* as the maximum amount of current guaranteed for the stable operation without trouble.

If the present value of amplitude TD is less than the maximum amplitude TDmax, the answer at step S17 is given negative "No", and the information processor 10 returns step S12 after the increment of the amplitude TD at step S14. Thus, the information processor reiterates the loop consisting of steps S12 to S17 so as to confirm that the solenoid-operated key actuator 12*a*/12*b* is responsive to the driving pulse signal S5 so as to drive the hammer 22 to produce the acoustic piano tone.

When the present value of amplitude TD reaches the maximum value TDmax, the answer at step S17 is changed to positive "Yes". Then, the information processor 10 writes the maximum amplitude TDmax in a register assigned to the maximum amplitude TDmax as by step S19. Thus, the information processor 10 determines a dynamic range, i.e., TDmin and TDmax for the solenoid-operated key actuator 12*a*/12*b*.

Subsequently, the information processor 10 divides the dynamic range between the minimum amplitude TDmin and the maximum amplitude TDmax into 127 sections, and assigns 128 values of amplitude to 128 gradations of MIDI velocity as by step S19. Thus, the relation between the dynamic range and the MIDI velocity is determined for the white key 20*b* assigned the key number "1".

Subsequently, the information processor 10 checks the register assigned to the key number KN to see whether or not the relation is determined for all the black and white keys 20*a*/20*b* as by step S20. While the answer at step S20 is being given negative "No", the information processor 10 increments the key number KN by one as by step S21, and repeats the jobs at S11 to S20 so as to determine the relation between the dynamic range and the MIDI velocity.

When the key number "88" is stored in the register, the relation has been determined for all the black and white keys 20*a*/20*b* and the answer at step S20 is given affirmative "Yes". With the positive answer, the information processor 10 completes the jobs in the subroutine program, and returns to the subroutine program S5. Thus, the first table is prepared through the execution of the subroutine program shown in FIG. 4.

The information processor 10 prepares the second table through the execution of subroutine program shown in FIG. 5. When the information processor 10 enters the subroutine program, the information processor 10 writes "1" in the register assigned to the key number KN as by step S22.

Subsequently the information processor 10 adjusts the driving pulse signal S5 to the minimum amplitude TDmin as by step S23, and requests the pulse width modulator 16 to supply the driving pulse signal S5 to the solenoid 12*a* associated with the white key 20*a* at the lowest pitch as by step S24. The minimum amplitude TDmin is read out from the first table. The driving pulse signal at the minimum amplitude TDmin causes the solenoid 12*a* to create the weakest magnetic field around the plunger 12*b* so that the plunger 12*b* softly pushes up the rear portion of the white key 20*b*. The key movement gives rise to the rotation of hammer 22 through the actuation of action unit 21. The hammer 22 is brought into collision with the string 23 at the end of rotation, and the acoustic piano tone is radiated from the soundboard 24*b*.

The string vibration signal S1, board vibration signal S2 and loudness signal S3 are supplied from the vibration sensors 14/13 and microphone 15 to the amplifier 17. The amplifier 17 increases the magnitude of those input signals S1/S2/S3, and outputs the analog test signal. The analog test signal is converted to the digital test signal, and the peak value of digital test signal is fetched by the information processor 10 as by step S25.

Figure 7:
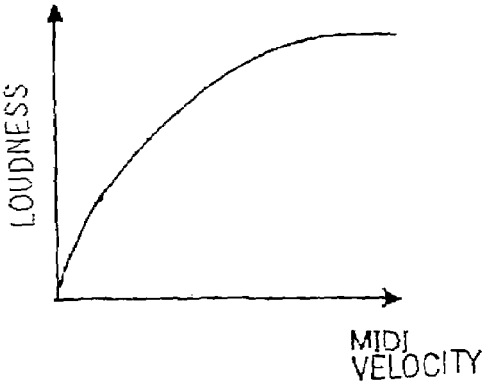
FIG. 7 is a graph showing the contents of a volume-to-MIDI velocity table.

Subsequently, the information processor 10 looks up a volume-to-MIDI velocity table, and determines the gradation of MIDI velocity as by step S26. The volume-to-MIDI velocity table has been prepared by the manufacturer, and is stored in the read only memory of the information processor 10. The manufacturer carried out experiments by using a standard grand piano equipped with high-precision sensors, and tabled the results of the experiments. The volume-to-MIDI velocity table defines relation between the loudness of acoustic piano tones and the MIDI velocity, and FIG. 7 shows the contents of the volume-to-MIDI velocity table. When the information processor accesses the volume-to-MIDI velocity table with the peak value of the digital test signal, the corresponding gradation of MIDI velocity is read out from the volume-to-MIDI velocity table.

Subsequently, the information processor 10 makes the amplitude TD of driving signal paired with the gradation of MIDI velocity, and stores the gradation of MIDI velocity together with the amplitude TD of driving signal in the random access memory as by step S27.

The information processor 10 checks the register assigned to the amplitude TD to see whether or not the white key 20*a* has been driven with the maximum amplitude TDmax as by step S28. While the answer is being given negative "No", the information processor 10 increments the amplitude TD by one as by step S29, and returns to step S24. The information processor 10 reiterates the loop consisting of steps S24 to S29, and makes the amplitude TD of driving signal S5 paired with the gradations of MIDI velocity.

The maximum amplitude TDmax has been paired with the gradation of MIDI velocity at step S27. The answer at step S28 is changed to affirmative "Yes". With the positive answer "Yes", the information processor 10 checks the register assigned to the key number KN to see whether or not the amplitude of driving pulse signal S5 has been paired with the gradations of MIDI velocity for all of the black and white keys 20*a* and 20*b* as by step S30.

Figure 8:
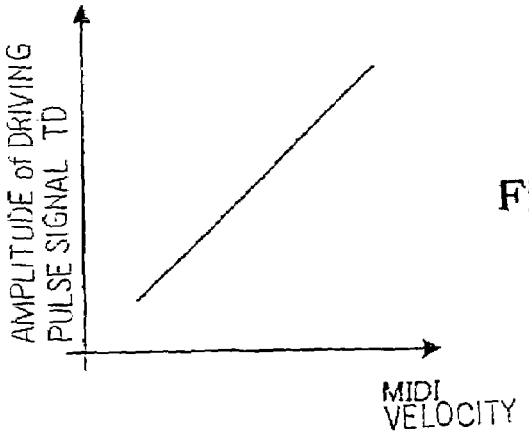
FIG. 8 is a graph showing the contends to a driving pulse signal-to-MIDI velocity table.

While the answer at step S30 is being given negative "No", the information processor 10 increments the key number KN by one as by step S31, and repeats the jobs at S23 to S31. When the maximum amplitude TDmax was paired with the gradation of MIDI velocity for the white key assigned the key number "88" at step S27, the answer at step S30 is changed to affirmative "Yes". The information processor 10 completes the jobs of the subroutine program, and returns to the subroutine program S5. Thus, the minimum amplitude TDmin to the maximum amplitude TDmax are respectively paired with the gradations of MIDI velocity, and are tabled as the second table. FIG. 8 shows the contents of the second table.

The information processor 10 further tables relation between the amplitude TD of driving pulse signal S5 and the time lag between the supply of driving pulse signal and the collision between the hammer 22 and the string 23. The information processor 10 firstly writes "1" into the register assigned the key number KN as by step S32, and requests the pulse width modulator 16 to adjust the driving pulse signal S5 to the minimum amplitude TDmin, which was determined through the execution of the jobs at steps S12 to S16, as by step S33.

Subsequently, the information processor 10 requests the pulse width modulator 16 to drive the solenoid 12*a* with the driving pulse signal S5 at TDmin as by step S34, and starts to measure a lapse of time. The driving pulse signal S5 at the minimum amplitude TDmin causes the solenoid 12*a* to create the weakest magnetic field around the plunger 12*b* so that the plunger 12*b* softly pushes tip the rear portion of the white key 20*b*. The key movement gives rise to the rotation of hammer 22 through the actuation of action unit 21. The hammer 22 is brought into collision with the string 23 at the end of rotation, and the acoustic piano tone is radiated from the soundboard 24*b*.

The string vibration signal S1, board vibration signal S2 and loudness signal S3 are supplied from the vibration sensors 14/13 and microphone 15 to the amplifier 17. The amplifier 17 increases the magnitude or those input signals S1/S2/S3, and outputs the analog test signal. The analog test signal is converted to the digital test signal, and the peak value of digital test signal is fetched by the information processor 10 as by step S35.

When the digital test signal exceeds the threshold, the information processor 10 ends the measurement of lapse of time, and determines the lapse of time from the supply of the driving pulse signal S5 to the collision between the hammer 22 and the string 23 as by step S36. The lapse of time is equivalent to the time lag from the time to "start to depress the key" and the time to "start to produce the tone", (See FIG. 2.)

The information processor makes the minimum amplitude TDmin paired with the lapse of time, and stores them in the random access memory as by step S37.

Subsequently, the information processor 10 checks the register assigned to the amplitude TD to see whether or not the black/white key has been driven with the driving pulse signal at the maximum amplitude TDmax as by step S38. While the answer at step S38 is being given negative "No", the information processor 10 increments the amplitude TD by one as by step S39, and returns to step S34. Thus, the information processor 10 reiterates the loop consisting of steps S34 to S39 so as to determine the relation between the amplitude TD and the lapse of time for each of the black and white keys 20*a* and 20*b*.

The maximum amplitude TDmax is paired with the lapse of time at step S37. Then, the answer at step S38 is changed to affirmative "Yes". With the positive answer at step S38, the information processor 10 checks the register assigned to the key tiumber KN to see whether or not the amplitude TD has been paired with the lapse of time for all of the black and white keys 20*a* and 20*b* as by step S40. While the answer at step S40 is being given negative "No", the information processor 10 increments the key number KN by one as by step S41, and repeats the jobs at steps S33 to S41.

Figure 9:
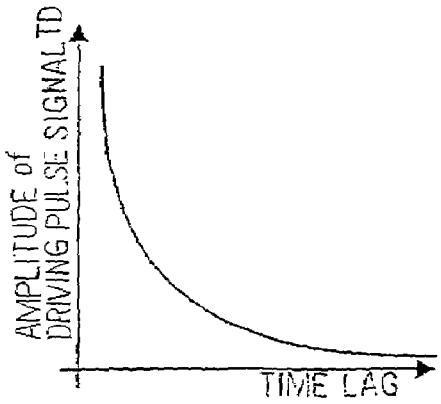
FIG. 9 is a graph showing the contents of a driving signal-to-delay table.

The amplitude TD is paired with the lapse of time for the white key assigned the key number "88" at step S37. Then, the answer at step S40 is given affirmative "Yes". Thus, the information processor 10 makes the minimum amplitude TDmin to the maximum amplitude TDmax paired with the lapse of time, and tables the relation between the amplitude TD and the lapse of lime as the third table. FIG. 9 shows the contents of the third table.

With the positive answer at step S40, the information processor 10 completes the jobs, and returns to the subroutine program S5. Upon completion of the first to third tables, the information processor 10 transfers the contents of the first to third tables in the memory device 11.

The second and third tables are used in the automatic playing as follows. A user is assumed to instruct the controlling unit 1 a to reenact a performance expressed by a set of music data codes through the automatic playing oil the acoustic grand piano 2. The music data codes are sequentially processed by the information processor, and the driving pulse signal S5 is supplied to the solenoids 12*a* associated with the black and white keys 20*a*/20*b* to be driven at proper timing.

The information processor 10 is assumed to start to process a note-on event code. The pieces of music data, which express the key number KN and MIDI velocity, are stored in the note-on event code. Then, the information processor 10 accesses the second table, and reads out the amplitude TDx, which is corresponding to the MIDI velocity, from the second table. The information processor 10 further accesses the third table and reads out the time lag, which corresponding to the amplitude TDx, from the third table.

The pulse width modulator 16 adjusts the driving pulse signal S5 to the amplitude TDx. When the lapse of time, which is equal to the time lag, is expired, the information processor 10 requests the pulse width modulator 16 to supply the driving pulse signal S5 to the solenoid 12*a*. The solenoid 12*a* creates the magnetic field with the driving pulse signal S5 at the amplitude TDx, and causes the plunger 12*b* to push the rear portion of the black/white key 20*a*/20*b*. Thus, the controlling unit 1*a* forces the black/white key 20*a*/20*b* to travel on the reference key trajectory and causes the hammer 22 to be brought into collision with the string 23 at the strength equal to that of the original performance.

As will be understood from the foregoing description, the controlling unit 1*a* determines the relation between the magnitude of driving signal and the MIDI velocity and the relation between the magnitude of driving signal and the time lag for the grand piano 2. Even if the automatic playing system is combined with another acoustic piano, the controlling unit 1*a* tailors the tables for the new acoustic piano. Thus, the automatic playing system of the present invention reenacts the performance on the keyboard musical instrument at high fidelity regardless of the individualities of the keyboard musical instrument.

The components required for the self-teaching are simple and not expensive. For this reason, the self-teaching function is economically furnished in the automatic playing system.

Second Embodiment

Figure 10:
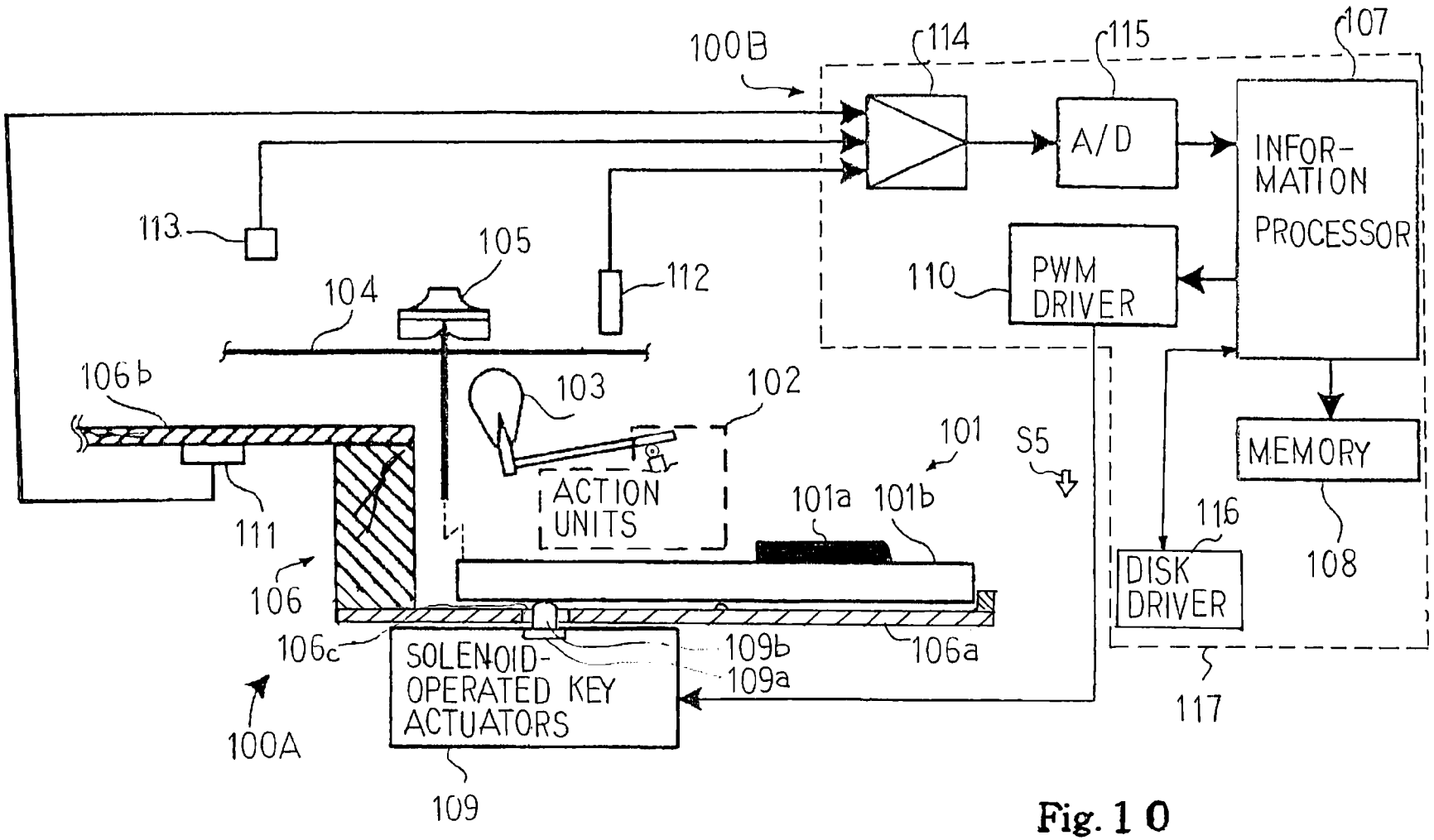
FIG. 10 is a schematic side view showing another automatic playing system of the present invention.

FIG. 10 illustrates another automatic playing system embodying the present invention. The automatic playing system is used in retrofitting. When a user wishes to retrofit his or her acoustic piano to an automatic player piano, the user gives the manufacturer of automatic playing systems an order for the automatic playing system. Workers visit the user, and retrofit the acoustic piano to an automatic player piano. In this situation, it is necessary to prepare the three tables for the automatic playing system.

Reference numeral 100A designates a grand piano already owned by a user. The grand piano 100A includes a keyboard 101, in which black keys 101*a* and white keys 101*b* arc incorporated action units 102, hammers 103, strings 104, dampers 105 and a piano cabinet 106. The keyboard 101, action units 102, hammers 103, strings 104 and dampers 105 are similar to the keyboard 20, action units 21, hammers 22, strings 23 and dampers 25, respectively. For this reason, no further description on those components 101, 102, 103, 104 and 105 is hereinafter incorporated for the sake of simplicity.

The piano cabinet includes a key bed 106*a* and a soundboard 106*b*. The soundboard 106*b* is same as the soundboard 24*b*. However, the workers form a slot 106*c* in the key bed 106*a* during the retrofitting work. The slot 106*c* laterally extends blow the rear portions of the black and white keys 101*a*/101*b*.

An automatic playing system, which is to be installed in the grand piano 100A, is designated by reference numeral 100B. The automatic playing system 100B includes an information processor 107, a memory device 108, a key driver unit 109, a PWM (Pulse Width Modulator) driver 110, vibration signals 111/112, a microphone 113, an amplifier 114, an analog-to-digital converter 115, which is abbreviated as "A/D", and a disk driver 116. These system components 107, 108, 110, 111, 112, 113, 114, 115 and 116 are same as the information processor 10, memory device 11, pulse with driver 16, vibration sensors 13/14, microphone 15, amplifier 17, analog-to-digital converter 18 and disk driver 19, and, for this reason, those system components 107, 108, 111, 112, 113, 114, 115 and 116 are not described for avoiding repetition. The information processor 107, memory device 108, PWM driver 110, amplifier 114, analog-to-digital converter 115 and disk driver 116 are assembled in a case, and those system components 107, 108, 110, 114, 115 and 116 and case form a controlling unit 117.

The computer program, which has the main routine program and subroutine programs shown in FIGS. 3 to 6, is installed in the information processor 107 so that the information processor 107 can prepare the first, second and third tables for the grand piano 100A through the self-teaching.

The key driver unit 109 is hung from the key bed 106*a* and includes solenoids 109*a* and plungers 109*b*. The solenoids 109 are associated with the black and white keys 101*a*/101*b*, and are energized with the driving pulse signal S5 so as to create magnetic fields around the plungers 109*b*. The plungers 109*b* upwardly project from the associated solenoids 109*a*, and pushes up the rear portions of the associated black and white keys 101*a*/101*b*.

As described hereinbefore, the slot 106*c* is formed in the key bed 106*a* in the retrofitting work. The retrofitting work is continued as follows. The workers hang the key driver unit 109 from the key bed 106*a*, and the plungers 109 are respectively aligned with the rear portions of the black and white keys 101*a*/101*b*. The workers fits the controlling unit 117 to the piano cabinet 106, and the vibration sensors 111/112 and microphone 113 are located at proper positions with respect to the soundboard 106*b* and strings 104. Finally, the workers connect the controlling unit 117 to the key drivel unit 109, vibration sensors 111/112 and microphone 113 by means of cables.

After completion of the retrofitting work, the worker turns on the power switch, and instructs the information processor 107 to prepare the first, second and third tables. The information processor 107 acknowledges the instruction for the self-teaching at S3 and the main routine program starts periodically branch into the subroutine program S5 as shown in FIG. 3.

As will be understood from the foregoing description, the information processor 107 prepares the control parameter tables such as the first to third tables for the grand piano 100A upon completion of retrofitting work. Since the control parameter tables are tailored after the retrofitting work, the individualities of grand piano 100A are reflected onto the contents of control parameter tables, and the automatic playing system 100*b* reproduces pieces of music at high fidelity.

Moreover, the vibrations sensors 111/112 and microphone 113 are economical rather than optical key sensors and optical hammer sensors. For this reason, the cost for the retrofitting is low.

Although particular embodiments of the present invention have been shown and described, it will be apparent to those skilled in the art that various changes and modifications may be made without departing from the spirit and scope of the present invention.

The hard disk driver may be replaced with another sort of memory driver with large data holding capability such as, for example, a flexible disk driver, a compact disk driver such as a CD-ROM driver, a magneto-optical disk driver or a memory card.

The computer program may be stored in the disk driver 19, and is transferred to the memory 11 after a system initialization.

The combination between the vibration sensors 13/14 or 111/112 and the microphone 15 or 113 does not set any limit to the technical scope of the present invention. One of the vibration sensors and microphone may be installed in an acoustic piano. Otherwise, an array of optical key sensors and an array of optical hammer sensors may be installed in an acoustic piano. A pressure sensor is available for an automatic playing system of the present invention.

The first, second and third tables do not set any limit to the technical scope of the present invention. An automatic playing system may prepare only the second table or third table. The control parameter or parameters to be required are dependent on a music data protocols. Since the MIDI protocols are employed in the automatic playing systems implementing the present invention, the magnitude of driving pulse signal is correlated with the MIDI velocity. If the loudness is expressed as a sound pressure in another sort of music protocols, the magnitude of driving signal is correlated with the sound pressure. Similarly, in case where the solenoid-operated key actuators are replaced with step motors, the MIDI velocity is correlated with the duty ratio of driving pulse signal. In case where the driving signal S5 is converted to a current signal such as, for example, PWN signal, the duty ratio is correlated with the MIDI velocity.

An external sound pressure meter may be further, connected to the control unit 1*a* or 117. A worker measures the sound pressure outside of the piano cabinet by means of the sound pressure meter, and the control parameter tables are corrected on the basis of the sound pressure measured outside of the piano cabinet.

The analog test signal may be selected from the three input signals, i.e., analog board vibration signal S2, analog string vibration signal S1 and analog loudness signal S3.

The present invention may appertain to a pedal driving unit of an automatic playing system for a musical instrument with plural pedals.

The grand pianos 2 and 100A do not set any limit to the technical scope of the present invention. The automatic playing system of the present invention may reproduce a performance on an upright piano, an electronic key-board or a mute piano. The mute piano is an acoustic piano equipped with a hammer stopper and an electronic tone generating system. Another automatic playing system may be designed for another sort of musical instrument such as a percussion instrument such as, for example, a celesta, a wind instrument such as, for example, a saxophone.

The component parts of the automatic playing systems 1 and 100B are correlated with claim languages as follows. The grand piano 2/100A is corresponding to a "musical instrument", and the black and white keys 20*a*/20*b* or 101*a*/101*b* serve as "manipulators". The vibration sensors 13/14 or 111/112 and microphone 15 or 113 form in combination a "sensor system". The loudness is an "attribute of tones", and the digital test signal is corresponding to a "detecting signal". The contents of the second and third tables are "control parameters". The data expressed by the MIDI velocity are corresponding to "pieces of music data", and the amplitude TD of the driving pulse signal and the lapse of time from the supply of the driving pulse signal to the collision between the hammers 22/103 and the strings 23/104 serve as "pieces of control data".

The pulse width modulator 16/110 and information processor 10/107, which executes the jobs at the steps S10 to S18, S20 and S21, serve as a "first experimenter", and the information processor 10/107, which executes the jobs at the steps S10, S19, S20 and S21, serves as an "assigner". The pulse width modulator 16/110 and information processor 10/107, which executes the jobs at the steps S22 to S26 and S28 to S31, serve as a "second experimenter", and the information processor 10/107, which executes the jobs at the steps S22, S27, S30 and S31, serves as a "first determiner". The pulse width modulator 16/110 and information processor 10/107, which executes the jobs at the steps S32 to S35 and 38 to 41, serve as a "third experimenter", and the information processor 10/107, which executes the step S36, serves as a "timer". The information processor 10/107, which executes the step S37, S40 and S41, serves as a "second determiner".

The action units 21/102, hammers 22/104, strings 23/104, soundboard 24*b*/106*b* and dampers 25/105 as a whole constitute a "mechanical tone generating system", and the strings 23/104 serve as "certain component parts".

What is claimed is:

1. An automatic playing system for producing tones through a musical instrument on the basis of a set of music data codes, comprising:

an array of actuators provided for manipulators of said musical instrument, and responsive to a driving signal so as to move said manipulators of said musical instrument for producing said tones;

a vibration sensor system for monitoring said musical instrument, and converting an attribute of said tones to a loudness detection signal expressing a quantity of said attribute loudness of said tones; and a controlling unit connected to said array of actuators and said sensor system, and including a parameter preparation unit adapted to preparing prepare control parameters optimum to said musical instrument and defining relation between pieces of music data stored in said music data codes and expressing the quantity of said attribute loudness of tone to be produced and pieces of control data used in adjustment of said driving signal to a magnitude on the basis of said loudness detection signal and said driving signal adjusted to testing magnitudes before an automatic playing for producing tones through said musical instrument on the basis of a set of music data codes, and a driving signal generating unit adapted to producing produce said driving signal on the basis of said music data codes and said control parameters in said automatic playing.

2. The automatic playing system as set forth in claim 1, in which said array of actuators, said sensor system and said controlling unit are portable so as to be combinable with another musical instrument.

3. The automatic playing system as set forth in claim 1, in which said actuators respectively moves said manipulators for specifying pitch of said tones to be produced.

4. The automatic playing system as set forth in claim 1, in which each of said actuators is capable of giving rise to movements of associated one of said manipulators different in velocity from one another, and the velocity of said manipulators results in difference in said quantity of said attribute.

5. The automatic playing system as set forth in claim 4, in which said manipulators are respectively assigned different pitch names so that the pitch of said tones and said quantity of said attribute are concurrently specified by the movement of said each of said manipulators for producing said tone.

6. The automatic playing system as set forth in claim 1, in which said controlling unit includes a first experimenter connected to said actuators and said sensor system and adapted to change said driving signal between a least test magnitude and a greatest test magnitude so as to determine a range of said magnitude in which said musical instrument produces said tones, an assigner connected to said first experimenter and adapted to assign values in said range to different quantities of said attribute expressed by said pieces of music data, a second experimenter connected to said actuators and said sensor system and adapted to change said driving signal between the minimum magnitude in said range and the maximum magnitude in said range so as to determine relation between the quantities of said attribute represented by said detecting signal and said different quantities of said attribute stored in said music data codes, and a first determiner connected to said second experimenter and adapted to determine said relation between said pieces of control data expressing the magnitude of said driving signal and the quantity of said attribute stored in said music data codes.

7. The automatic playing system as set forth in claim 6, in which said controlling unit further includes a third experimenter connected to said actuators and said sensor system and adapted to change said driving signal between the minimum magnitude in said range and the maximum magnitude in said range so as to determine a time at which said tones are produced, a timer connected to said third experimenter and adapted to measure a lapse of time between supply o said driving signal to said actuators and said time at which said tones are produced, and a second determiner connected to said third experimenter and said timer and adapted to determining said relation between said pieces of control data expressing the magnitudes of said driving signal and said lapse of time.

8. The automatic playing system as set forth in claim 1, in which said sensor system includes a microphone adapted to convert said tones to said detecting signal.

9. The automatic playing system as set forth in claim 8, in which said detecting signal expresses loudness of said tones as said attribute.

10. The automatic playing system as set forth in claim 1, in which said musical instrument further includes a mechanical tone generator responsive to the movements of said manipulators and producing said tones through vibrations of certain component parts of said mechanical tone generator.

11. The automatic playing system as set forth in claim 10, in which said sensor system includes at least one vibration sensor monitoring said certain component parts so as to convert said vibrations to said detecting signal.

12. The automatic playing system as set forth in claim 11, in which said at least one vibration sensor is formed by an electromagnetic pickup device.

13. The automatic playing system as set forth in claim 11, in which said sensor system further includes a microphone converting said tones to another detecting signal.

14. The automatic playing system as set forth in claim 13, in which said another detecting signal is merged into said detecting signal.

15. The automatic playing system as set forth in claim 10, in which said mechanical tone generator includes action units respectively linked with said manipulators and actuated when said manipulators are moved, hammers respectively driven for rotation by said action units when said action units are actuated, and strings provided on trajectories of said hammers and struck with said hammers at the end of said rotation so as to vibrate for producing said tones.

16. A method of preparing control parameters for a musical instrument, said method comprising the steps of:

a) supplying a driving signal adjusted to a testing magnitude to an actuator provided in association with a manipulator of said musical instrument so as to drive said manipulator for producing a tone;

b) sensing vibration of said musical instrument to produce a loudness detection signal expressing loudness of said tone and analyzing said loudness detection signal to determine relation between loudness of said tone and said testing magnitude;

c) changing said driving signal from said testing magnitude to another testing magnitude while continuing to produce said tone;

d) repeating said steps b) and c) so as to determine relation between loudness of said tone and said testing magnitudes; and e) analyzing said relation between said testing magnitudes and said loudness of said tone for preparing said control parameters optimum to said musical instrument and defining relation between pieces of music data stored in music data codes used in an automatic playing and expressing the loudness of said tone and pieces of control data used in adjustment of said driving signal to a magnitude appropriate to production of tones respectively having quantities of said attribute indicated by said pieces of music data.

17. The method as set forth in claim 16, in which said manipulator is a key forming a keyboard together with other keys.

18. The method as set forth in claim 17, in which said key and said other keys are connected to a mechanical tone generator producing said tones through vibrations of certain component parts of said mechanical tone generator.

19. The method as set forth in claim 16, in which said detecting signal is supplied from a microphone.

* * * * *